US009534311B2

(12) United States Patent
Clifford et al.

(10) Patent No.: US 9,534,311 B2
(45) Date of Patent: Jan. 3, 2017

(54) ROBOTIC PRETREATMENT AND PRIMER ELECTRODEPOSITION SYSTEM

(71) Applicant: FANUC AMERICA CORPORATION, Rochester Hills, MI (US)

(72) Inventors: Scott J. Clifford, Rochester Hills, MI (US); Frank Matuska, Rochester Hills, MI (US); Dean Waineo, Rochester Hills, MI (US); Paul Andrew Santi, Washington, MI (US)

(73) Assignee: Fanuc America Corporation, Rochester Hills, MI (US)

( * ) Notice: Subject to any disclaimer, the term of this patent is extended or adjusted under 35 U.S.C. 154(b) by 484 days.

(21) Appl. No.: 13/958,686

(22) Filed: Aug. 5, 2013

(65) Prior Publication Data

US 2014/0034487 A1 Feb. 6, 2014

Related U.S. Application Data

(60) Provisional application No. 61/679,391, filed on Aug. 3, 2012.

(51) Int. Cl.
*C25D 17/06* (2006.01)
*C25D 13/22* (2006.01)

(52) U.S. Cl.
CPC ..... *C25D 17/06* (2013.01); *C25D 13/22* (2013.01)

(58) Field of Classification Search
CPC ..... C25D 5/08; C25D 7/00; C25D 17/04; C25D 17/06
See application file for complete search history.

(56) References Cited

U.S. PATENT DOCUMENTS

| | | | | |
|---|---|---|---|---|
| 5,110,440 | A * | 5/1992 | Case | B65G 49/0454 118/416 |
| 5,651,822 | A | 7/1997 | Heckmann | |
| 6,139,708 | A * | 10/2000 | Nonomura | B05D 1/18 118/423 |
| 6,174,423 | B1 * | 1/2001 | Wood | B05C 3/04 204/512 |
| 6,419,983 | B1 | 7/2002 | Kreuzer | |
| 6,676,755 | B2 | 1/2004 | Ehrenleitner et al. | |
| 7,026,015 | B2 | 4/2006 | Kreuzer | |
| 7,323,059 | B2 | 1/2008 | Weinand | |
| 7,383,939 | B2 | 6/2008 | Kreuzer et al. | |
| 7,393,444 | B2 | 7/2008 | Ehrenleitner | |
| 7,644,679 | B2 | 1/2010 | Ehrenleitner | |

(Continued)

FOREIGN PATENT DOCUMENTS

DE 10326605 A1 * 1/2005 ..... C25D 13/22

*Primary Examiner* — Ciel Thomas
(74) *Attorney, Agent, or Firm* — Fraser Clemens Martin & Miller LLC; William J. Clemens

(57) ABSTRACT

A system for the pretreatment and primer electrodeposition of an assembly is provided. The system includes one or more large envelope, heavy payload robots configured to grasp the assembly and arrange the assembly in a substantially vertical orientation. The one or more robots are further configured to vertically raise and lower the assembly. A tank is configured to receive the assembly in a substantially vertical orientation. The tank is further configured to impart a liquid onto the assembly. The liquid imparted onto the assembly is configured to improve the corrosion resistance of the assembly.

22 Claims, 9 Drawing Sheets

(56) References Cited

U.S. PATENT DOCUMENTS

| | | | | |
|---|---|---|---|---|
| 2001/0000396 | A1* | 4/2001 | Dordi | C25D 17/12<br>204/212 |
| 2006/0226011 | A1 | 10/2006 | Hartung et al. | |
| 2009/0250346 | A1 | 10/2009 | Weschke et al. | |
| 2010/0319617 | A1* | 12/2010 | Robbin | B65G 49/0463<br>118/423 |

* cited by examiner

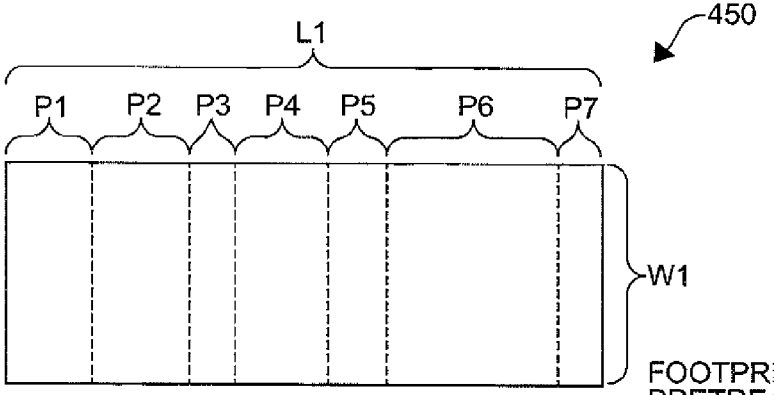
FIG. 4a FOOTPRINT OF SINGLE LINE IMPROVED PRETREATMENT AND PRIMER ELECTRO-DEPOSITION SYSTEM
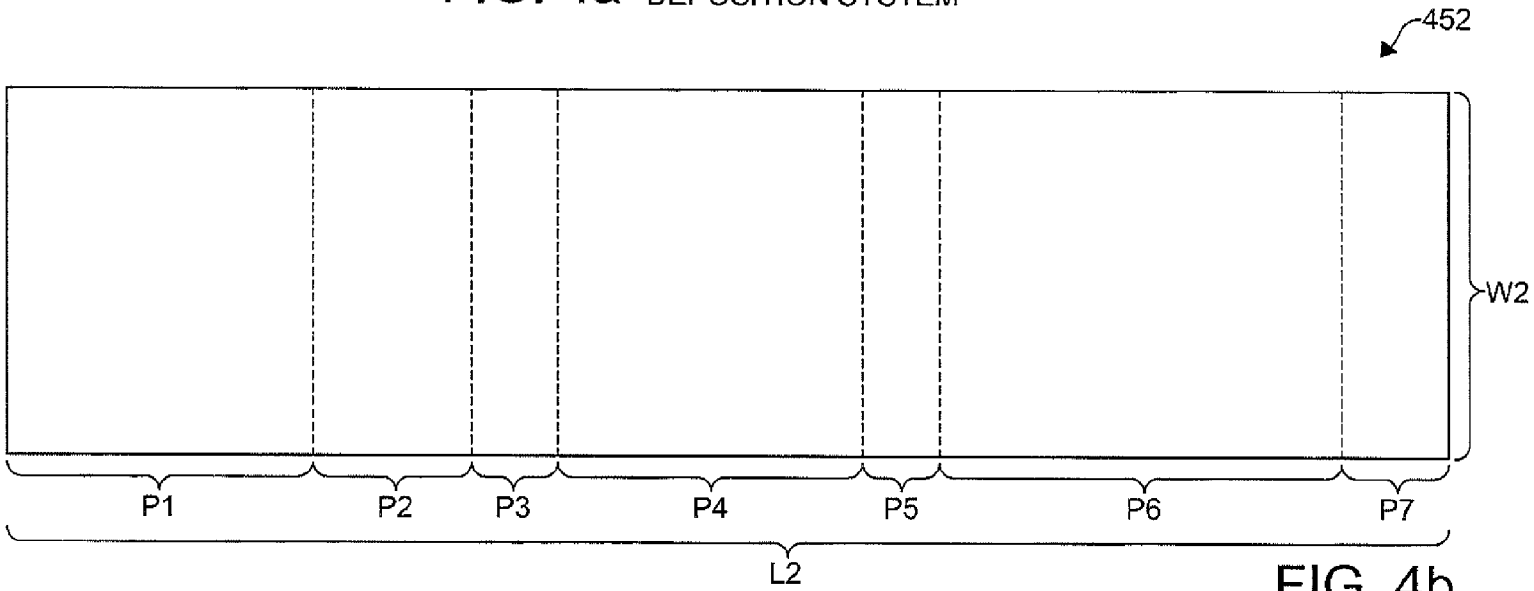
FIG. 4b FOOTPRINT OF CONVENTIONAL SINGLE LINE PRETREATMENT AND PRIMER ELECTRO-DEPOSITION SYSTEM

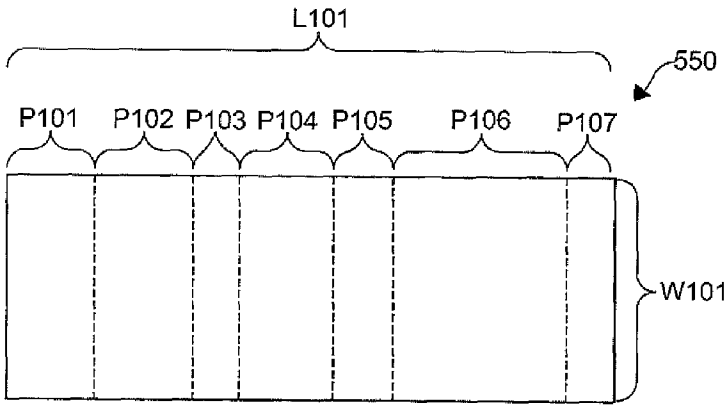
FIG. 6a FOOTPRINT OF DUAL LINE IMPROVED PRETREATMENT AND PRIMER ELECTRO-DEPOSITION SYSTEM
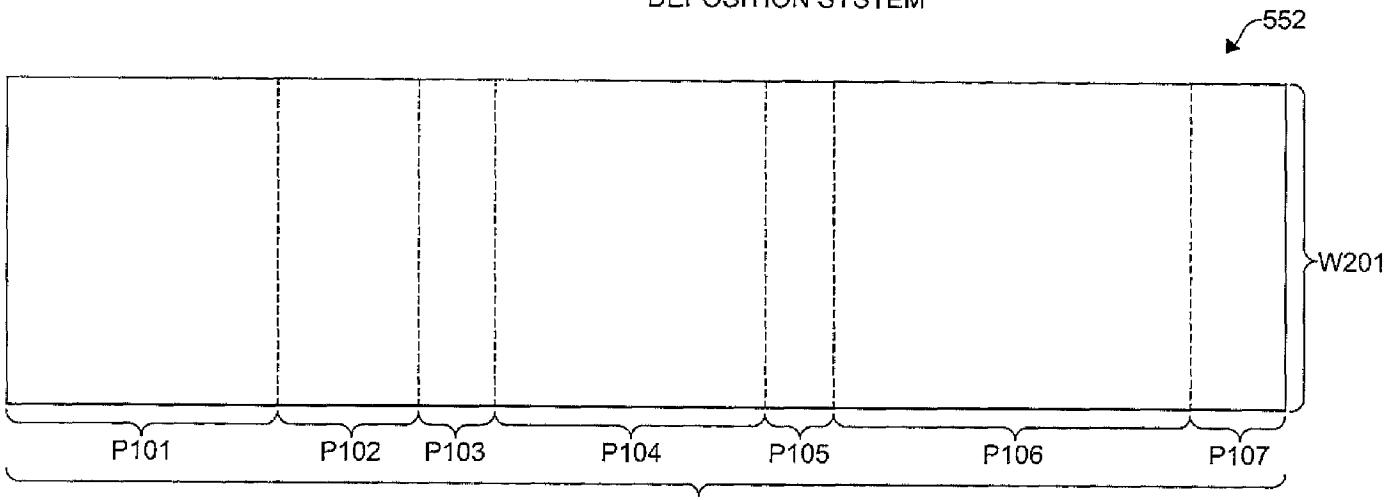
FIG. 6b FOOTPRINT OF CONVENTIONAL SINGLE LINE PRETREATMENT AND PRIMER ELECTRO-DEPOSITION SYSTEM

Fig 7

| *Process Group* | *Tank* | *Specific Process* | *Sequence Description* | *Station Time* | *Robot* |
|---|---|---|---|---|---|
| P1 (Cleaning) | T1 | Cleaning Spray | Move from transfer to T1, drop, hook, raise, hook & drain | 60 | R1 |
| | T2A, T2B | Cleaning Immersion | Move from T1 to T2A or T2B, drop, hook, submerse, raise, hook & drain | 120 | R2 |
| P2 (Rinsing) | T3 | Rinsing Spray | Move from T2A or T2B to T3, drop, rinse, hook & drain | 60 | R3 |
| | T4 | Rinsing Spray | Move from T3 to T4, drop, rinse, hook & drain | 60 | R4 |
| | T5A, T5B | Rinsing Immersion | Move from T4 to T5A or T5B, drop, hook, submerse, raise, hook & drain | 120 | R5 |
| P3 (Conversion Coating) | T6A - T6C | Conversion Coating Immersion | Move from T5A or T5B to T6A, T6B or T6C, drop, hook, submerse, raise, hook & drain | 180 | R6 |
| P4 (Rinsing) | T7 | Rinsing Spray | Move from T6A, T6B or T6C to T7, drop, rinse, hook & drain | 80 | R7 |
| | T8 | Rinsing Spray | Move from T7 to T8, drop, rinse, hook & drain | 80 | R8 |
| | T9A, T9B | Rinsing Immersion | Move from T8 to T9A or T9B, drop, hook, submerse, raise, hook & drain | 120 | R9 |
| | T10 | Blow-off | Move from T9A or T9B to T10, drop, blow-off, raise, blow-off, drop, raise & hook | 60 | R10 |
| P5 (Conversion Coating) | T11A – T11D | Conversion Coating Immersion | Move from T10 to T11A, T11B, T11C or T11D, drop, hook, submerse, raise, hook & drain | 240 | R11 |
| P6 (Rinsing) | T12 | UF Rinsing Spray | Move from T11A-T11D to T12, drop, rinse, hook & drain | 60 | R12 |
| | T13 | UF Rinsing Spray | Move from T12 to T13, drop, rinse, hook & drain | 60 | R13 |
| | T14A, T14B | UF Rinsing Immersion | Move from T13 to T14A or T14B, drop, hook, submerse, raise, hook & drain | 120 | R14 |
| | T15 | UF Rinsing Spray | Move from T14A or T14B to T15, drop, raise, hook & drain | 60 | R15 |
| | T16 | DI/RO Rinsing Spray | Move from T15 to T16, drop, raise, hook & drain | 60 | R16 |
| | T17 | DI/RO Rinsing Spray | Move from T16 to T17, drop, raise, hook & drain | 60 | R17 |
| P7 (Dry) | T18 | DI/RO Rinsing Spray | Move from T17 to T18, drop, raise, hook & dwell | 80 | R18 |

ROBOTIC PRETREATMENT AND PRIMER ELECTRODEPOSITION SYSTEM

RELATED APPLICATIONS

This application claims the benefit of U.S. Provisional Patent Application No. 61/679,391, filed Aug. 3, 2012, the disclosure of which is incorporated herein by reference.

BACKGROUND

An automobile assembly plant can have at least three main areas: the body shop, the paint shop and the assembly area. Assemblies including automotive car bodies, panels and large parts are conveyed from the body shop to the paint shop. After entering the paint shop, the assemblies require a series of metal pretreatment processes, including surface cleaning, conversion coating, and primer paint electrodeposition. In many instances, the assemblies are formed from bare steel structures and panels that are combined together using known processes. Prior to passing the assemblies to the sealer area and finally to the decorative topcoat paint application, the assemblies are hung from a conveyor and passed through several spray stations, draining stations, immersion tanks, drying stations and, finally, a baking oven to dry an electrodeposited primer material. The processes prior to the baking oven can consist alternately of several spraying, draining, drying and immersing zones. The length of the zones can vary and are generally based on production throughput and corresponding conveyor speed. The number of zones is extensive and a typical paint shop may have in the range of 40 such zones or steps in the overall process. The amount of space required for this overall process is large and can require a building size of approximately 16,000 $m^2$. The amount of water and energy required for this process makes it attractive for efficiency improvement.

Various attempts to improve the processes in the pretreatment and electrodeposition area of the paint shop have been considered. In certain efforts, one to three additional degrees of freedom have been added to the conveyor so that the assemblies can be immersed in a non-horizontal position and rotated vertically or horizontally while entering in or leaving the immersion tank. Other efforts have included improvements in the electrical contact with the assemblies during the conveying process. More recent advancements include the motorization of each assembly carrier and the electrical isolation of the assemblies from the conveyor or grounded contact. The more recent advancements have mostly targeted the processes involving the primer paint electrodeposition immersion tank. Only minor process improvements in the cleaning, conversion coating and rinsing processes have been realized.

While some of these process changes have provided improvements in the process, the additional cost, complexity, and maintenance requirements do not always merit changing from the traditional approach. As one example, each conveyance carrier must have a significant cost increase to provide the additional rotary axis. Additionally, the rotational component can be subjected to harsh conditions while it is often submerged with the assembly. Paint must be occasionally stripped from the submerged portion of the part holding carriers and since they are now more geometrically complex, the paint is more difficult to remove. The harsh environment also requires additional maintenance on the submersed portion of the rotary joint, including greasing, seal replacement, and electrical contact repair.

It would be advantageous if the paint shop processes could be improved while at the same time reducing capital cost and improving system maintainability.

SUMMARY

The above objects as well as other objects not specifically enumerated are achieved by a system for the pretreatment and primer electrodeposition of an assembly. The system includes one or more large envelope, heavy payload robots configured to grasp the assembly and arrange the assembly in a substantially vertical orientation. The one or more robots are further configured to vertically raise and lower the assembly. A tank is configured to receive the assembly in a substantially vertical orientation. The tank is further configured to impart a liquid onto the assembly. The liquid imparted onto the assembly is configured to improve the corrosion resistance of the assembly.

According to this invention there is also provided a system for the pretreatment and primer electrodeposition of an assembly. The system includes one or more robots and one or more tanks associated with the robots. The tanks are arranged in a succession. The robots are configured to move the assemblies through the succession of tanks.

Various objects and advantages of this invention will become apparent to those skilled in the art from the following detailed description of the preferred embodiment, when read in light of the accompanying drawings.

BRIEF DESCRIPTION OF THE DRAWINGS

FIG. 4*a* is a plan view of the footprint of the production line of FIG. 3.

FIG. 4*b* is a plan view of a comparable footprint of a conventional production line.

FIG. 6*a* is a plan view of the footprint of the production line of FIG. 5.

FIG. 6*b* is a plan view of a comparable footprint of a conventional production line.

FIG. 7 is a table illustrating individual production process steps for the first embodiment of the production line of FIG. 3.

DETAILED DESCRIPTION OF THE INVENTION

Figure 1:
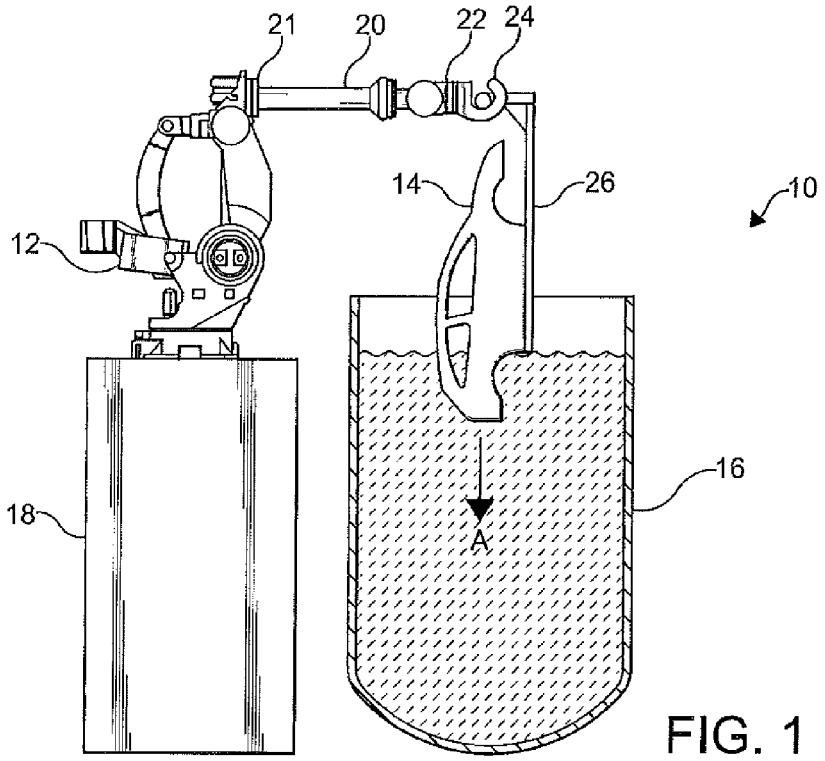
FIG. 1 is a side view, in elevation, of a treatment station shown with an assembly positioned for immersion in a tank.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose an improved pretreatment and primer electrodeposition system (hereafter "system") for use automotive paint shops. Generally, the system employs large work envelope, heavy payload robots to transfer large assemblies and large parts between treatment stations of a production line without the aid of a conveyor or other parts transfer devices. The assemblies and large parts can enter a production line by conveyor and are subsequently taken from the conveyor by the robots. The assemblies and large parts are handed downstream from robot to robot without having a conveying device between treatment stations. The treatment stations include tanks. The tanks are either filled with a liquid for immersion of the assemblies or large parts, or are equipped with an array of spray nozzles for cleaning or rinsing. In certain instances, the tanks can be equipped with both the liquid and spray nozzles. In certain instances, the steps of the production line require multiple tanks because the process time may be longer. The treatment stations can be configured to clean and coat the assemblies and large parts. The terms "assemblies" and "large parts", as used herein, is defined to mean any large component or combination of components, such as the non-limiting examples of car bodies, panels or frames. The improved system diverges significantly from traditional linear conveyance methods and offers a unique approach that can significantly reduce the cost, footprint, energy and water requirements of paint shop systems.

Referring now to FIG. 1, a first embodiment of a treatment station is shown generally at 10. The treatment station 10 is configured such that a robot 12 causes immersion of an assembly 14, having a substantially vertical orientation, into a vertically oriented tank 16. The robot 12 can be any desired large work envelope, heavy payload system sufficient to lift the assembly 14, arrange the assembly in a substantially vertical orientation, and subsequently lower the assembly 14 into the tank 16. One non-limiting example of a suitable robot 12 is the M-2000iA Robot manufactured by Fanuc Robotics America Corporation, headquartered in Detroit, Mich. However, it should be appreciated that other robots can be used.

Referring again to FIG. 1, optionally the robot 12 can be mounted atop a stand 18. The stand 18 is configured to provide sufficient vertical height for the robot 12 to lift the assembly 14 such as to be completely immersed in a substantially vertical orientation, into the tank 16. It should be appreciated that in other embodiments, the robot 12 can be configured such that the stand 18 is not required. The stand 18 can be any desired framework or structure sufficient to provide sufficient vertical height for the robot 12 to lift the assembly 14 such as to be completely immersed, in a substantially vertical orientation, into the tank 16.

Referring again to FIG. 1, the robot 12 includes an arm 20. The arm 20 has a proximal end 21 that is connected to the robot 12 and a distal end 22. The distal end 22 of the arm 20 includes an arm fixture 24. The arm fixture 24 is configured to secure a faceplate 26. In the illustrated embodiment, the arm fixture 24 has the form of a hook. However, in other embodiments, the arm fixture 24 can have other forms sufficient to secure a faceplate 26.

The faceplate 26 is configured for attachment to the assembly 14. In the illustrated embodiment, the faceplate 26 is formed from tubular or structural steel, although in other embodiments other materials can be used sufficient for attachment to the assembly 14. In the illustrated embodiment, the faceplate 26 is attached via fasteners (not shown) inserted into normal mounting holes (not shown) in the structural underside of the assembly 14. In alternate embodiments, the faceplate 26 can be attached to the assembly 14 by other methods. In the illustrated embodiment, the robot 12 is configured to provide six degrees of freedom at the faceplate 26. Alternatively, the robot 12 can provide less than six degrees of freedom at the faceplate 26.

In operation, the robot 12 takes the assembly 14 from an adjacent robot (not shown) and lowers the assembly 14 into the tank 16, in the direction indicated by direction arrow A, with the assembly 14 arranged in a substantially vertical orientation.

Figure 2A:
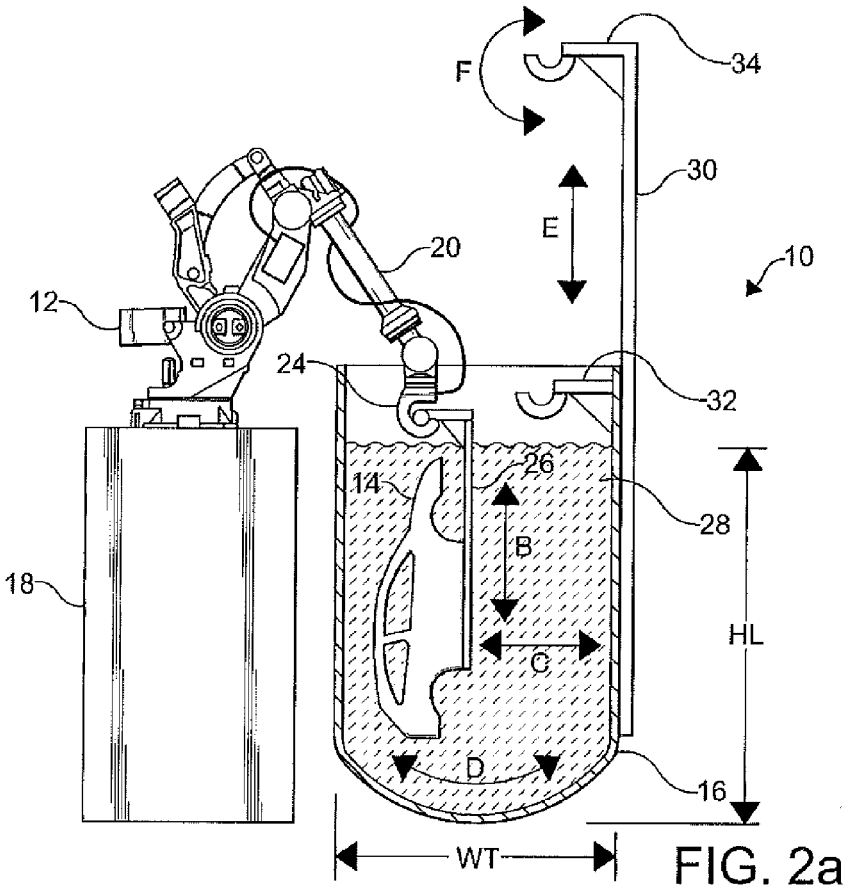
FIG. 2*a* is a side view, in elevation, of the treatment station of FIG. 1 shown with the assembly immersed within a liquid in the tank.

Referring now to FIG. 2*a*, the assembly 14 is shown submerged, in a substantially vertical orientation, in the tank 16. In this orientation, a significant portion of the faceplate 26 can also be submerged in the tank 16. The tank 16 is substantially filled with an appropriate liquid 28.

The tank 16 is configured to retain the liquid 28. In certain embodiments, the tank 16 can be formed from non-metallic composite materials, such as for example reinforced polyethylene, sufficient to retain the liquid 28. In other embodiments, other materials can be used.

Referring again to FIG. 2*a*, the liquid 28 has a height HL. The height HL of the liquid is configured to ensure the assembly is completely immersed within the liquid 28. In the illustrated embodiment, the height HL is greater than width WT of the tank 16. However, in other embodiments, the height HL can be more or less than the width WT of the tank 16 sufficient to ensure the assembly is completely immersed within the liquid 28.

In the embodiment illustrated in FIG. 2*a*, the tank 16 has a substantially circular cross-sectional shape. However, it is within the contemplation of this invention that the tanks can have other cross-sectional shapes, including the non-limiting examples of square or rectangular cross-sectional shapes.

Referring again to FIG. 2*a*, once the assembly 14 is submersed in the tank 16, the arm 20 of the robot 12 can move the assembly 14, within the liquid 28, in any desired direction. Non-limiting examples of directions moved by the assembly 14 include vertical directions as indicated by direction arrow B, horizontal directions as indicated by direction arrow C or in circular directions as indicated by direction arrow D.

The treatment station 10 shown in FIGS. 1 and 2*a* and described above provides significant benefits, although all of the benefits may not be achieved in all instances. First, without being bound by the theory, it is believed that movement of the assembly 14 in a substantially vertical orientation while immersed in the liquid 28 improves the results of the cleaning, conversion coating, and electrodeposition painting operations. Second, it is further believed that the immersion of an assembly 14 having a substantially vertical orientation advantageously allows the assembly 14 to be immersed faster than methods that immerse an assembly having a substantially horizontal orientation. Third, the immersion of a vertically oriented assembly 14 advantageously helps to eliminate entrapped air, and thereby improves cleaning, which results in a better uniformity of coating material.

Referring again to FIG. 2*a*, optionally the treatment station 10 can include a holding device 30. The holding device 30 is generally configured to retain the faceplate 26 in different vertical positions, thereby allowing various process steps to be completed on the assembly 14. The holding device 30 can have a lower fixture 32 and an upper fixture 34. In certain instances, the faceplate 26 can be moved from the arm fixture 24 to the lower fixture 32 such that the assembly 14 is maintained in an immersed position within the tank 16. In other instances, the faceplate 26 can be raised to the upper fixture 34. The upper fixture 34 is configured such that the assembly 14 is no longer immersed in the tank 14, thereby achieving a draining position. In certain instances the upper fixture 34 can be used as a hand-off position such that downstream robots (not shown) can grasp the faceplate 26 and move the assembly 14 to downstream operations (not shown).

While the holding device 30 illustrated in FIG. 2 has been described as having lower and upper fixtures 32, 34, it should be appreciated that the holding device 30 can have any desired quantity of fixtures, located at any desired positions and configured for any process tasks. In still other embodiments, the lower and upper fixtures 32, 34, can be moved in any desired direction, such as for example, raised or lowered as indicated by direction arrow E or in circular directions as indicated by direction arrow F. The movement actuation of the holding device fixtures and can be external or controlled by the robot 12, by devices such as an external auxiliary electric servo (not shown).

Referring again to FIG. 2*a*, optionally the faceplate 26 can be attached to a force transducer (not shown). The force transducer is configured to ensure the assembly 14 is properly engaged by the robot 26 and further configured to ensure the assembly 14 is not damaged by loads imparted during the process. In other instances, other methods can be used to ensure the assembly 14 is properly engaged by the faceplate 26 and the robot 12, such as for example, feedback from a robot axes servomotor (not shown).

Figure 2B:
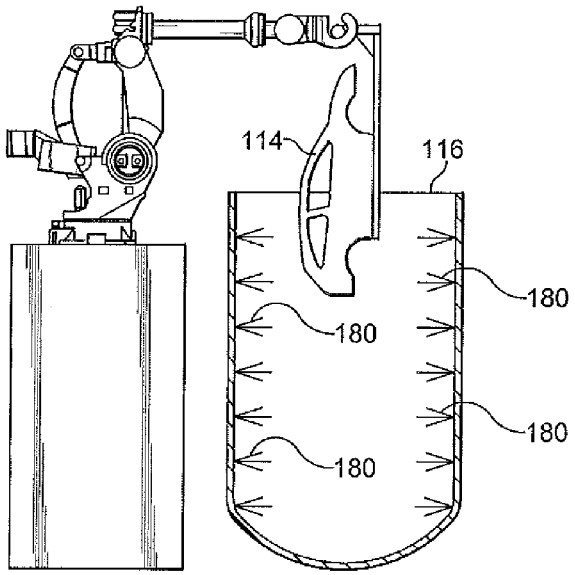
FIG. 2*b* is a side view, in elevation, of a second embodiment of a tank for the treatment station of FIG. 1 shown with an array of spray nozzles.

While the tank 16 has illustrated in FIGS. 1 and 2*a* are configured for immersion of the assembly 14, it should be appreciated that the tanks can be configured for other process steps. Referring first to FIG. 2*b*, an alternate tank 116 is illustrated. The tank 116 is equipped with an array of nozzles 180 configured for spraying the assembly 114 as the assembly 114 is lowered into the tank 116 or raised out of the tank 116. Spraying of the assemblies 114 is used for cleaning, rinsing or coating processes. The nozzles 180 can form any desired array and can be configured to spray any desired liquid or coating onto the assembly 114. Any desired quantity of nozzles 180 can be used.

Figure 2C:
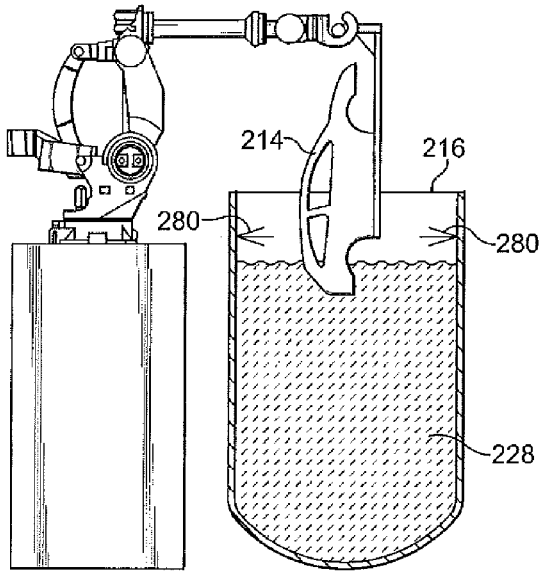
FIG. 2*c* is a side view, in elevation, of a third embodiment of a tank for the treatment station of FIG. 1 shown with an array of spray nozzles positioned above an immersion liquid.

Referring now to FIG. 2*c*, another embodiment of a tank is shown at 216. In this embodiment, the tank 216 includes a combination of an immersion liquid 228 and an array of spray nozzles 280 positioned above the immersion liquid 228. In certain instances, fresh or filtered quantities of the immersion liquid 228 can be sprayed on the assembly 214 following an immersion step to force dirt, chemicals, or excess paint from the assembly 214 and back into the tank 216 as the assembly exits the immersion liquid 228. In other instances, the assembly 214 can be sprayed prior to immersion into the liquid 228.

Figure 2D:
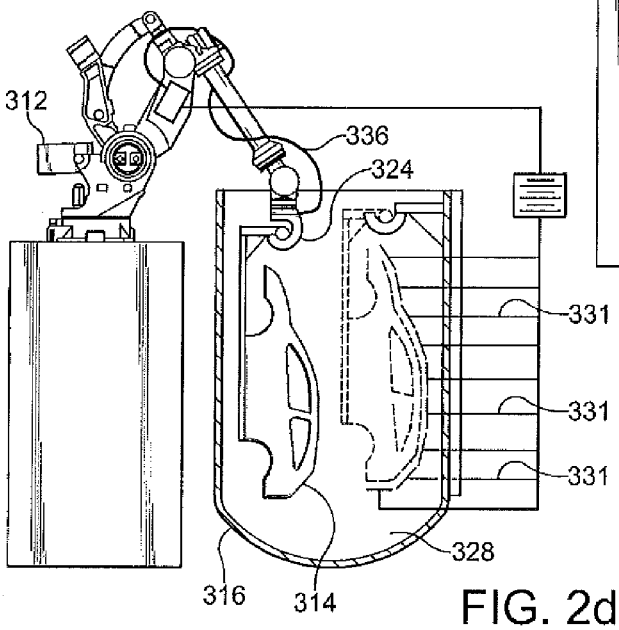
FIG. 2*d* is a side view, in elevation, of a fourth embodiment of a tank for the treatment station of FIG. 1 shown with an array of electrodes.

In still other embodiment as shown in FIG. 2*d*, a tank 316 can be equipped with an array of electrodes 331 positioned in a manner that contours the surface of the assembly 314. The distance between the assembly 314 and the electrodes 331 is controlled to improve the uniformity of the coating thickness for critical surfaces of the assembly.

The embodiment illustrated in FIG. 2*d* also provides energy savings. The distance between the assembly 314 and the electrodes 331 is minimized as compared to the conventional linear bath system. The liquid 328 is a suspension of paint particles in de-ionized water, thereby being slightly resistive. The paint bath imparts a voltage drop as the current is forced from the electrodes 331 to the surfaces of the assembly 314. Minimizing the distance and subsequently the voltage drop reduces the energy or throwing poser required to coat the assembly 314; moreover, the lost energy heats the bath requiring a heat exchanger to maintain a constant temperature. The contoured electrodes 331 will reduce the amount of energy required to transport the paint to the part and to keep the bath at a constant temperature.

Referring again to FIG. 2*d*, the opposing polarity is connected to the assembly 314 either by direct contact via the robot tooling or with the part hanging devices. This eliminates the cost and maintenance of the moving brush contact bars commonly used in today's moving line conveyor type systems. It should be understood that the robot 312 can have the ability to move the assembly 314 into and out of the contoured array of electrodes 331 during the paint electrodeposition process.

The robot 312 can be equipped with a cable 336. The cable 336 can be attached to the faceplate 324. The cable 336 is configured to ground or charge the assembly 314 in a positive or negative manner such as to aid in the electrodeposition process.

While the treatment station 10 illustrated in FIGS. 1, and 2*a*-2*d* have been described above as having a lone robot and a lone tank, it should be appreciated that multiple treatment stations can be coupled together to form larger production systems in which assemblies can be moved about the multiple treatment stations with robots. The larger production systems employ large work envelope, heavy payload robots to transfer large assemblies between treatment stations forming the production line without the aid of a conveyor or other parts transfer devices. The assemblies can enter a production line by conveyor and are subsequently taken from the conveyor by the robots. The assemblies and large parts are handed downstream from robot to robot without having a conveying device between treatment stations. The treatment stations can include tanks configured for a variety of process steps as described above.

Figure 3:
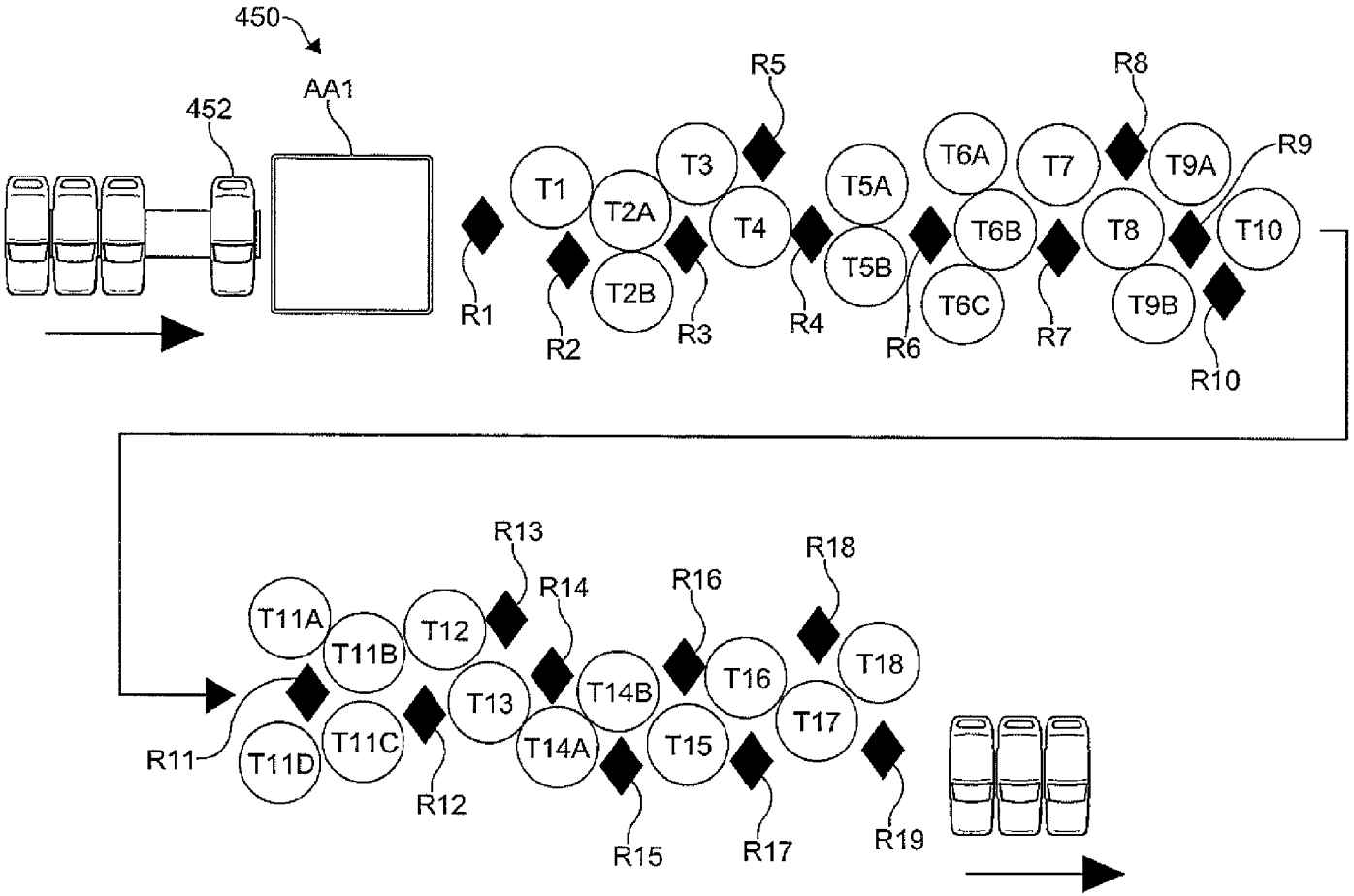
FIG. 3 is a schematic illustration of a first embodiment of a production line employing multiple treatment stations.

Referring now to FIG. 3, a production system, formed from multiple treatment stations and multiple robots (hereafter "system") is shown generally at 450. The system 450 is configured such that large envelope, heavy payload robots are not only used to handle the assemblies within the tanks, but also used to convey the assemblies from one process step to another. The system 450 includes all the steps required in a pretreatment and electrodeposition process and has the capability to produce sixty jobs per hour. The components and operation of the system 450 will be discussed in more detail below.

An unanticipated benefit of the system 450 is a reduced footprint when compared to conventional paint shop systems. The term "footprint", as used herein, is defined to mean a production area having a width and a length. Referring now to FIG. 4*a*, the footprint of the system 450 is shown having width W1 and length L1. Within the footprint of the system 450 are the various robots and tanks required for the process steps shown in FIG. 3, and described in detail in FIG. 7, as follows: process group P1 (cleaning steps) includes robots R1 and R2 and tanks T1, T2A and T2B, process group P2 (rinsing) includes robots R3-R5 and tanks T3, T4, T5A and T5B, process group P3 (conversion coating) includes robot R6 and tanks T6A-T6C, process group P4 (rinsing) includes robots R7-R10 and tanks T7, T8, T9A, T9B and T10, process group P5 includes robot R11 and tanks T11A-T11D, process group P6 includes robots R12-R17 and tanks T12, T13, T14A, T14B, T15, T16 and T17, and finally process step P7 includes robot R18 and tank T18.

Referring now to FIG. 4*b*, a footprint of a conventional paint shop system 452 is illustrated as having width W2 and length L2. The term "conventional paint shop system", as used herein, is defined to mean methods that immerse an assembly having a substantially horizontal orientation. The conventional paint shop system 452 has largely comparable process groups P1-P7. As can be readily seen from a comparison of FIGS. 4*a* and 4*b*, the footprint of the system 450 occupies a fraction of the footprint of the conventional paint shop system 452. In the illustrated embodiment, the footprint of the system 450 occupies on average approximately 27.8% of the footprint of the conventional paint shop system 452. However, it should be appreciated that in other embodiments, the footprint of the system 450 can occupy more or less than 41.5% of the footprint of the conventional paint shop system 52.

Figure 4C:
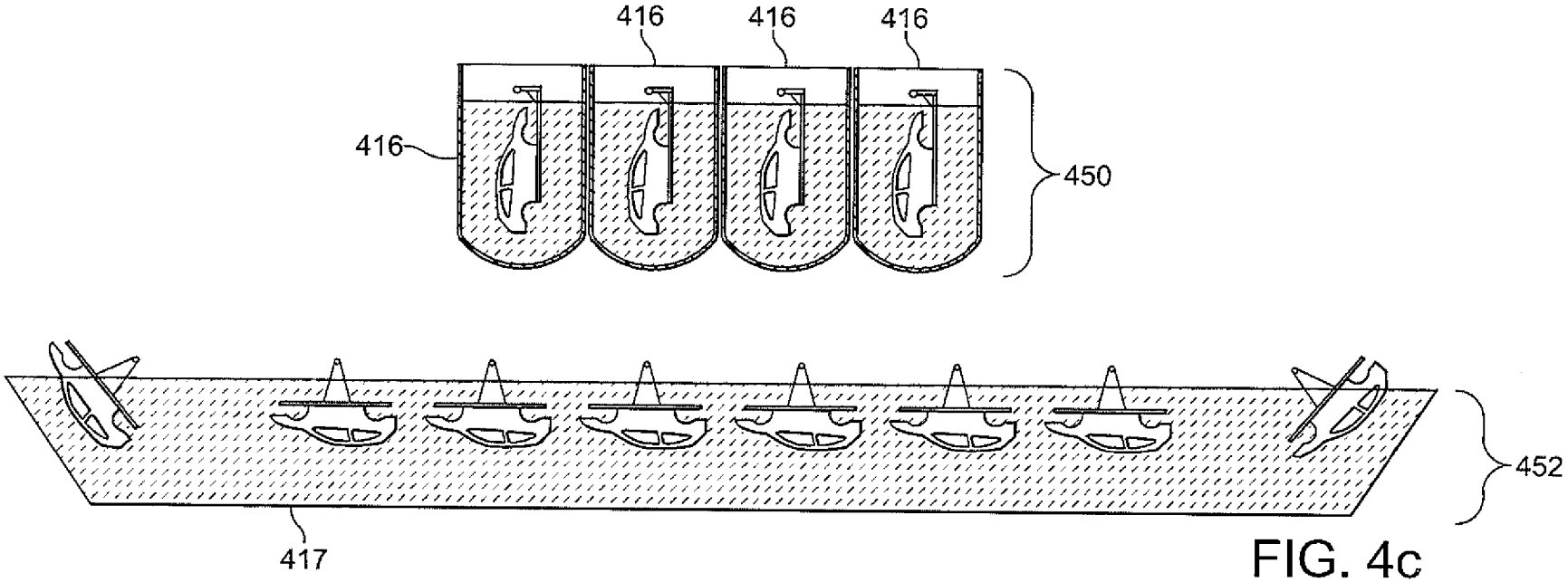
FIG. 4*c* is a side view, in elevation, comparing the footprint of the production line of FIG. 3 with the footprint of the conventional production line of FIG. 4*b*.

Referring now to FIG. 4*c*, a comparison can be made between the tank size of the vertical robotic dipping process 450 and the conventional inverted continuous conveyor process 452. The process 450 shows a plurality of tanks 416, each of which represents a different process step, and all of which are vertically oriented. In contrast, the conventional process 452 shows a lone tank 417 incorporating comparable process steps. Both processes 450, 452 are designed to produce sixty jobs per hour. A comparison shows a tank volume and footprint length reduction of greater than 50%.

Referring again to FIG. 3, utilizing the vertical tank dipping system 450 shown in FIG. 3, also called the "candlestick" approach, not only reduces the footprint, but also offers a significant reduction in the amount of liquid required for the many immersion operations. Having a vertical tank also lessons the amount of liquid exposed to ambient air. These improvements result in savings in the use of water and energy.

Retelling again to FIGS. 3 and 7, the process provided by the system 450 begins with a supply of assemblies 452. Incoming assemblies are received by conveyor from the body shop in a horizontal or "lay-down" position. The assemblies are taken from the conveyor by robots and moved to a vertical position and the faceplate (not shown) is secured to the underside of the assembly 452 in production area AA1. The faceplate to assembly connection is tested to ensure the assembly is secured. Robots can be used in this process sequence as well. FIG. 7 provides a table that describes the individual sequential processes and timing.

Sequentially, each assembly is processed through process groups P1-P7 by robots and without a conveyor or other conveyance device. P1 involves cleaning of the assembly with spray cleaning tank T1, and immersion cleaning tanks T2A and T2B. The assembly is conveyed through process group P1 by robots R1 and R2. Following cleaning process P1, process group P2 involves rinsing of the assembly with spray rinsing tanks T3 and T4, and immersion rinsing tanks T5A and T5B. The assembly is conveyed through process group P2 by robots R3-R5. Following rinsing process P2, process group P3 involves a conversion coating of the assembly with immersion tanks T6A-T6D. The assembly is conveyed through process group P3 by robot R6. Following conversion coating process P3, process group P4 involves another rinsing of the assembly with spray rinsing tanks T7 and T8, immersion rinsing tank T9A and T9B and blow-off tank T10. The assembly is conveyed through process group P4 by robots R7-R10. Next, process group P5 involves another conversion coating assembly with immersion tank T11A-T11D. The assembly is conveyed through process group P5 by robot R11. Following conversion coating process P5, process group P6 involves another rinsing of the assembly with UF spray rinsing tanks T12 and T13, UF immersion rinsing tanks T14A and T14B, UF rinsing spray tank T15, DI/RO rinsing spray tanks T16 and T17. The assembly is conveyed through process group P5 by robots R12-R17. Finally, process group P7 involves a drying of the assembly with DI/RO spray rinsing tank T18. The assembly is conveyed through process group P7 by robot R18. As illustrated by FIG. 3, the assemblies 452 are handled from robot to robot without additional conveyance devices.

While the system 450 has been illustrated in FIGS. 3 and 7 as having the above described process groups and sequences, it should be obvious that other systems can employ other process groups and sequences without departing from the scope of the invention.

Figure 5A:
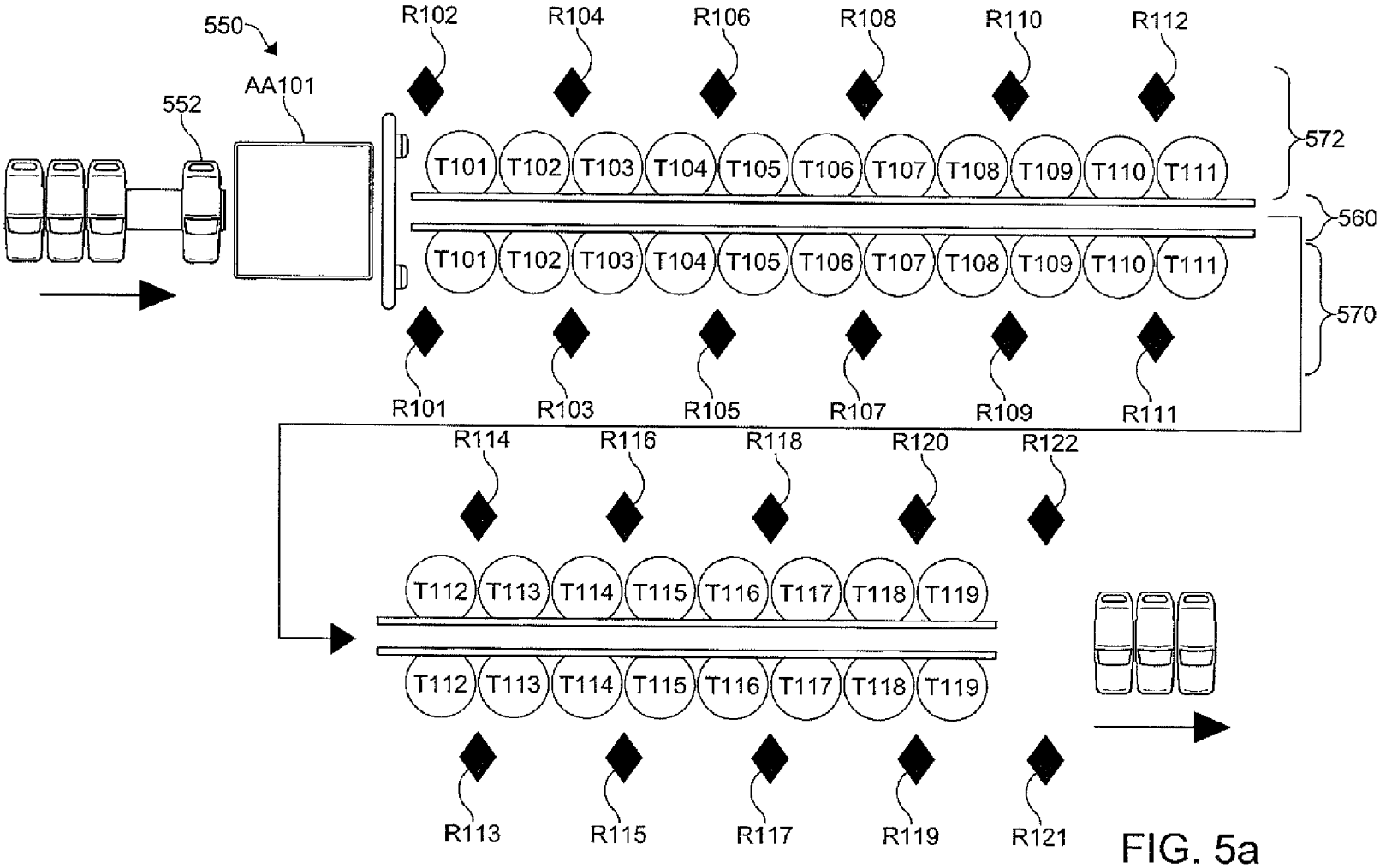
FIG. 5*a* is a schematic illustration of a second embodiment of dual production lines employing multiple treatment stations and multiple robots.
Figure 5B:
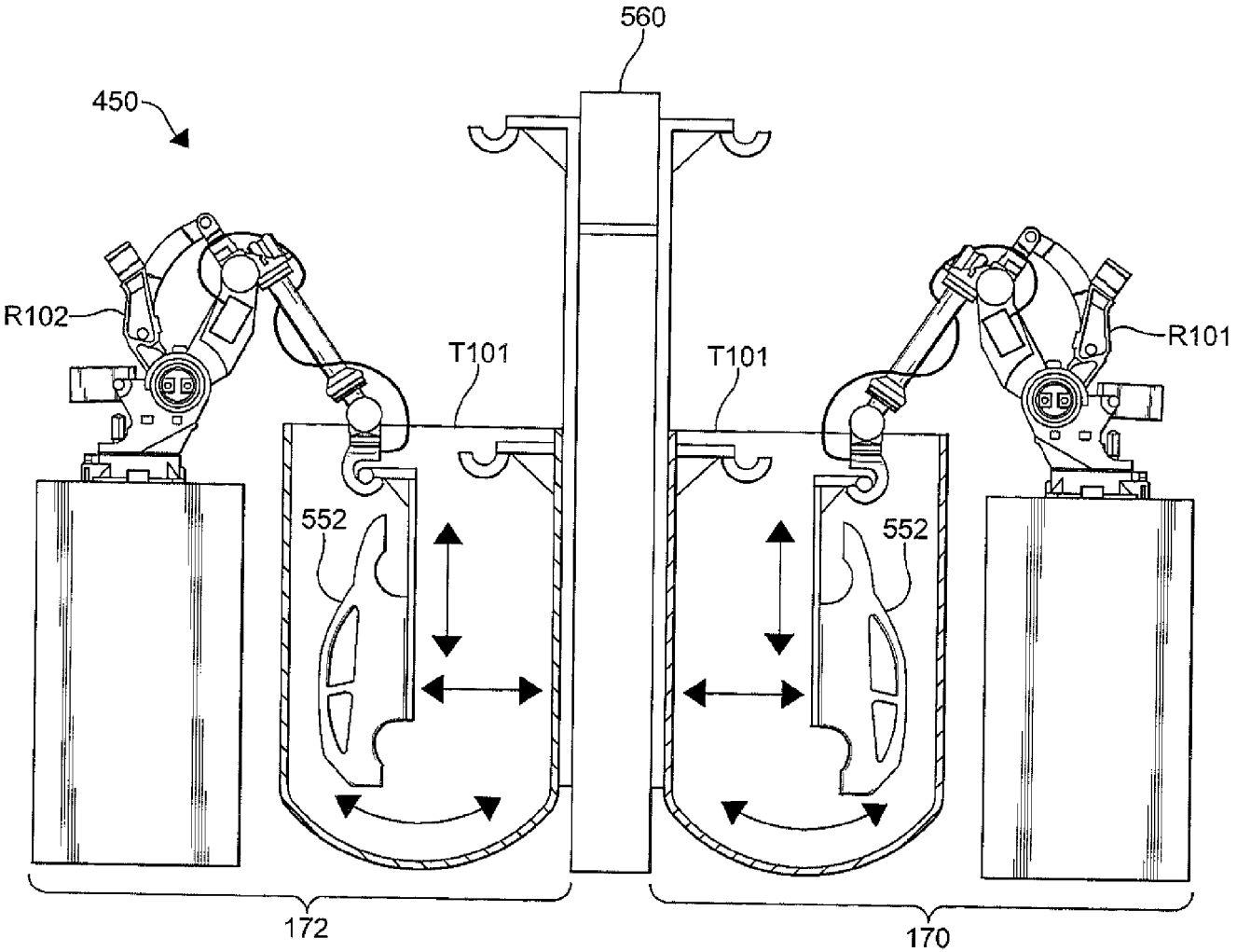
FIG. 5*b* is a side view, in elevation, or a portion of the dual production line of FIG. 5*b*.

While the pretreatment and electrodeposition process shown in FIGS. 3 and 7 has a "single" line, that is, the production throughput is confined to a lone path, it should be appreciated that treatment stations and robots can be used in production lines having other configurations. Referring now to FIGS. 5*a* and 5*b*, a "dual line" system is shown generally at 550. The term "dual line", as used herein, is defined to mean the production throughput is split between two production lines and a linear conveying device positioned between the two production lines.

Referring again to FIGS. 5*a* and 5*b*, the dual line system 550 includes a first production line 572 having robots R102, R104, R106, R108, R110, R112, R114, R116, R118, R120 and R122, and tanks T101-T119. A second production line 570 includes robots R101, R103, R105, R107, R109, R111, R113, R115, R117, R119 and R121 and their associated tanks T101-T119. Conveyance device 560 is positioned between the first and second production lines 572, 570.

Referring again to embodiment illustrated in FIGS. 5*a* and 5*b*, the robots 8102 R101-R122 and the tanks T101-

T119 are the same as, or similar to the robots R1-R19 and the tanks T1-T18 illustrated in FIG. 3 and described above. However, in other embodiments, the robots R101-R122 and the tanks T101-T119 can be different from the robots R1-R19 and the tanks T1-T18. Each of the production lines 570, 572 is configured to include all of the pretreatment and electrodeposition process steps.

Referring again to FIGS. 5*a* and 5*b*, the conveyance device 560 is configured to carry the assemblies 552 between the tanks where robots are not present. In operation, a robot places the assembly 552 on the conveyance device 560 and the assembly 552 is transported to the next robot.

In the embodiment illustrated in FIGS. 5*a* and 5*b*, the conveyance device 560 is a conveyor-based system configured to attach to the faceplate (not shown). However, it should be appreciated that the conveyance system 560 can have any desired structure sufficient to carry assemblies 552 between robots.

While the embodiment illustrated in FIGS. 5*a* and 5*b* illustrate the use of a lone conveyance device 560, it should be appreciated that in other embodiments, more than one conveyance device can be used between the first and second production lines 572, 570.

In a manner similar to the "single" line process 450 illustrated in FIG. 3, an unanticipated benefit of the system 550 is a reduced footprint when compared to conventional paint shop systems. Referring now to FIG. 6*a*, the footprint of the system 550 is shown having width W101 and length L101. Within the footprint of the system 550 are various robots and tanks required for the process steps P101-P107. In the illustrated embodiment, the process steps P101-P107 are the same as, or similar to, the process steps P1-P7 shown in FIG. 3, and described in detail in FIG. 7. However, it should be appreciated that the process steps P101-P107 can be different from the process steps P1-P7.

Referring now to FIG. 6*b*, a footprint of a conventional paint shop system 552 is illustrated as having width W201 and length L201. The conventional paint shop system 552 has largely comparable process groups P101-P107. As can be readily seen from a comparison of FIGS. 6*a* and 6*b*, the footprint of the system 550 occupies a fraction of the footprint of the conventional paint shop system 552. In the illustrated embodiment, the footprint of the system 450 occupies on average approximately 51.8% of the footprint of the conventional paint shop system 552. However, it should be appreciated that in other embodiments, the footprint of the system 550 can occupy more or less than 51.8% of the footprint of the conventional paint shop system 552.

Referring again to FIG. 5*a*, although the dual line system 550 is not as compact as the single line system 450 shown in FIG. 3, the dual line system 550 offers the benefits over the single line system 450. As one benefit, in the event a robot or tank malfunctions on one side of the production line, 50% of the production rate can be delivered through the opposing production line 570 or 572 rather than having all of the production interrupted by the malfunction. Also, in times of lower production demand, one of the production lines 570 or 572 can be idled to reduce operational cost. While the dual line system 550 may add additional cost over the single line system 450 due to the additional robots, tanks, and shuttle system devices; however, the dual line system 550 still offers many advantages over conventional paint shop systems in terms of capital cost, space and utility requirements.

The single line and dual line systems 550, 550 shown in FIGS. 3 and 5*a* provide significant benefits, although all of the benefits may not be achieved in all instances. First, the systems 450, 550 results in a savings in building capital expenditure and associated heating and cooling energy cost by significantly reducing production footprint. Second, the substantially vertical orientation of the assembly results in a reduction of the primer electrodeposition liquid. In some instance the reduction can be from approximately 370 $m^3$ to 120 $m^3$. This similar volume reduction ratio would be offered in other tanks as well thus reducing water consumption due to changeover and evaporation.

Third, because the tanks are made of non-metallic composite materials, they will have some insulating properties compared to using conventional rectangular welded stainless steel tanks. This is an advantage for both electrical isolation and for reducing heat loss. Fourth, the surface area of the exposed liquid at the top of the tanks can be reduced by as much as 80%. Accordingly, the energy required to heat or cool the liquids within the tanks will be reduced.

Fifth, submersion of the assemblies, with the assemblies having the substantially vertical orientation, allows the assemblies to immerse at a faster rate with less turbulence in the liquid. Accordingly, lower immersion turbulence will develop less foam in the tanks. Sixth, the substantially vertical orientation of the assemblies allows the liquid to flood all compartments of the assembly, thereby substantially eliminating the air pockets that could be experienced with the horizontal dip process. Seventh, the substantially vertical orientation of the assemblies may also reduce dirt defects on the horizontal surfaces due to the surface flow conditions.

Eighth, in another embodiment that uses additional tanks, multi-color primer capabilities can be added to the production lines. This capability may be helpful to reduce the film thickness of subsequent paint layers.

Finally using the robot conveyance method eliminates the need for the complex and expensive electrical contact system used in the conventional linear conveyor type systems. The electrical contact used in the systems 450, 550 can be a single point and can be easily connected to an arm fixture or to an insulated robot.

While the embodiments of the systems illustrated in FIGS. 1-7 show a vertically oriented assembly positioned within a vertically oriented tank, it is within the contemplation of this invention that the assembly can have other orientations, such as for example, horizontal orientations, when positioned within a vertically oriented tank. Simply, the orientation of the assembly within the tank does not affect inventive concept that large work envelope, heavy payload robots are employed to transfer large assemblies between treatment stations of a production line without the aid of a conveyor or other parts transfer devices.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A system for pretreatment and primer electrodeposition of an assembly, the assembly being one of a vehicle body, a vehicle panel and a vehicle frame, the system comprising:

a tank configured to receive the assembly in a vertical orientation, a longest dimension of the assembly disposed in the vertical orientation; and a robot having an arm with three axes of rotation and a distal end, the robot having a stationary base to which the arm is connected, the base fixedly mounted at a location spaced apart from and adjacent to the tank, the distal end being configured to attach and hold the assembly in the vertical orientation, the longest dimension of the assembly disposed in the vertical orientation, the robot being configured to move the distal end over the tank, to vertically lower the assembly into the tank and to vertically raise the assembly out of the tank by rotation of the arm about the three axes of rotation while maintaining the vertical orientation.

2. The system according to claim 1 wherein the tank contains a liquid to a height sufficient to immerse the assembly when the robot has lowered the assembly into the tank.

3. The system according to claim 2 including at least one spray nozzle positioned in the tank above the liquid to rinse the assembly during at least one of the robot lowering the assembly into the tank and the robot raising the assembly out of the tank.

4. The system according to claim 1 including an array of electrodes positioned in the tank for electrodepositing paint onto the assembly.

5. The system according to claim 4 wherein the electrodes of the array are positioned to contour the assembly and the robot is configured to move the assembly horizontally in the tank, while maintaining the vertical orientation, to a desired distance from the array of electrodes.

6. The system according to claim 4 wherein the robot carries a cable configured to ground or charge the assembly to aid in the electrodeposition of the paint.

7. The system according to claim 4 wherein the tank is a first tank for electrodepositing a first color paint, including a second tank having another array of electrodes positioned therein for electrodepositing a second color paint onto the assembly, and wherein the robot is configured to move the distal end over the second tank, to vertically lower the assembly into the second tank and to vertically raise the assembly out of the second tank.

8. The system according to claim 1 including an array of spray nozzles positioned in the tank for at least one of cleaning and rinsing the assembly.

9. The system according to claim 1 including a conveyance device for carrying the assembly to and from the robot.

10. A system for pretreatment and primer electrodeposition of an assembly, the assembly being one of a vehicle body, a vehicle panel and a vehicle frame, the system comprising:

a tank configured to receive the assembly in a vertical orientation, a longest dimension of the assembly disposed in the vertical orientation;

a robot having an arm with three axes of rotation and a distal end, the robot having a stationary base to which the arm is connected, the base fixedly mounted at a location spaced apart from and adjacent to the tank, the distal end being configured to attach and hold the assembly in the vertical orientation, the longest dimension of the assembly disposed in the vertical orientation; and a holding device configured to receive the assembly in the vertical orientation from the robot, wherein the robot is configured to move the assembly from the distal end to the holding device by rotation of the arm about the three axes of rotation while maintaining the vertical orientation, and wherein the holding device is configured to lower the assembly into the tank and to raise the assembly out of the tank in the vertical orientation.

11. A system for pretreatment and primer electrodeposition of an assembly, the assembly being one of a vehicle body, a vehicle panel and a vehicle frame, the system comprising:

a tank configured to receive the assembly in a vertical orientation, a longest dimension of the assembly disposed in the vertical orientation;

a robot having an arm with three axes of rotation and a distal end, the robot having a stationary base to which the arm is connected, the base fixedly mounted at a location spaced apart from and adjacent to the tank, the distal end being configured to attach and hold the assembly in the vertical orientation, the longest dimension of the assembly disposed in the vertical orientation; and a holding device configured to receive the assembly in the vertical orientation from the robot, wherein the robot is configured to move the assembly from the distal end to the holding device by rotation of the arm about the three axes of rotation while maintaining the vertical orientation, and wherein the holding device is configured to maintain the assembly in the tank in the vertical orientation.

12. A system for pretreatment and primer electrodeposition of assemblies, each of the assemblies being one of a vehicle body, a vehicle panel and a vehicle frame, the system comprising:

a first robot having an arm with three axes of rotation and a distal end configured to attach to one of the assemblies and hold the one assembly in a vertical orientation, a longest dimension of the assembly disposed in the vertical orientation;

a first tank configured to receive the one assembly in the vertical orientation, the longest dimension of the assembly disposed in the vertical orientation, the first robot having a stationary base to which the arm is connected, the base being fixedly mounted at a first location spaced apart from and adjacent to the first tank, the first robot being configured to move the one assembly over the first tank, to vertically lower the one assembly into the first tank and to vertically raise the one assembly out of the first tank by rotation of the arm about the three axes of rotation;

a second robot having an arm with three axes of rotation and a distal end configured to receive the one assembly from the first robot and hold the one assembly in the vertical orientation, the longest dimension of the assembly disposed in the vertical orientation; and a second tank configured to receive the one assembly in the vertical orientation, the longest dimension of the assembly disposed in the vertical orientation, the second robot having a stationary base to which the arm is connected, the base being fixedly mounted at a second location spaced apart from and adjacent to the second tank, the second robot being configured to move the one assembly over the second tank, to vertically lower the one assembly into the second tank and to vertically raise the one assembly out of the second tank by rotation of the arm about the three axes of rotation.

13. The system according to claim 12 wherein each of the first and second tanks is one of an immersion tank for immersing the one assembly and a spray tank for at least one of cleaning and rinsing the one assembly.

14. The system according to claim 12 wherein each of the first and second tanks has a diameter less than a height of the one assembly in the vertical orientation.

15. The system according to claim 12 wherein at least one of the first and second tanks has at least one spray nozzle positioned above a liquid in the at least one tank to rinse the one assembly during at least one of the lowering and the raising.

16. The system according to claim 12 including an array of spray nozzles positioned in one of the first and second tanks for at least one of cleaning and rinsing the one assembly.

17. The system according to claim 12 including an array of electrodes positioned in one of the first and second tanks for electrodepositing paint onto the one assembly.

18. The system according to claim 17 wherein the array of electrodes is positioned to contour the one assembly, a one of the first and second robots associated with the one tank is configured to move the one assembly horizontally in the one tank, while maintaining the vertical orientation, to a desired distance from the array of electrodes.

19. The system according to claim 17 wherein the one of the first and second robots associated with the one tank carries a cable configured to ground or charge the one assembly to aid in the electrodeposition of the paint.

20. A system for pretreatment and primer electrodeposition of assemblies, each of the assemblies being one of a vehicle body, a vehicle panel and a vehicle frame, the system comprising:

a linear conveyance device for transporting the assemblies along a production line being positioned adjacent to the conveyance device;

tanks included in the production line, each of the tanks being configured to receive any one of the assemblies in a vertical orientation; and robots, each of the robots having an arm with a distal end being configured to attach and hold one of the assemblies in the vertical orientation while vertically lowering the one assembly into and vertically raising the one assembly out of at least one of the tanks adjacent the robots, wherein the conveyance device carries the assemblies between at least two of the robots.

21. The system according to claim 20 further comprising:

wherein the production line is a first production line, the tanks are first tanks and the robots are first robots;

a second production line being positioned adjacent to the conveyance device, the first and second production lines being positioned on opposite sides of the conveyance device;

second tanks included in the second production line, each of the second tanks being configured to receive any one of the assemblies in a vertical orientation; and second robots included in the second production line, each of the second robots having an arm with a distal end being configured to attach and hold the one of the assemblies in the vertical orientation while vertically lowering the one assembly into and vertically raising the one assembly out of at least one of the second tanks adjacent the second robots, wherein the conveyance device carries the assemblies between two of the robots included in one of the first and second production lines.

22. The system according to claim 20 wherein the conveyance device includes a holding device and at least one of the robots is configured to move the one assembly from the distal end to the holding device.

* * * * *